US010189175B2

(12) United States Patent
Beerens

(10) Patent No.: US 10,189,175 B2
(45) Date of Patent: Jan. 29, 2019

(54) CHAINSAW GUIDE BAR NOSE ASSEMBLY

(71) Applicant: Global GB Asia Ltd., Central Hong Kong (HK)

(72) Inventor: Thomas Beerens, Mt. Waverley (AU)

(73) Assignee: Global GB Asia Ltd., Central Hong Kong (HK)

( * ) Notice: Subject to any disclaimer, the term of this patent is extended or adjusted under 35 U.S.C. 154(b) by 120 days.

(21) Appl. No.: 15/157,761

(22) Filed: May 18, 2016

(65) Prior Publication Data

US 2016/0339598 A1 Nov. 24, 2016

(30) Foreign Application Priority Data

May 22, 2015 (AU) ..... 2015901897

(51) Int. Cl.
*B27B 17/12* (2006.01)
*B27B 17/02* (2006.01)

(52) U.S. Cl.
CPC ..... *B27B 17/12* (2013.01); *B27B 17/025* (2013.01)

(58) Field of Classification Search
CPC ..... B27B 17/12; B27B 17/025; B27B 17/04; F02B 63/02
USPC ..... 30/381–387, 515, 165
See application file for complete search history.

(56) References Cited

U.S. PATENT DOCUMENTS 3,044,506 A * 7/1962 Oehrli ..... B27B 17/12 30/123.4
3,578,779 A * 5/1971 Ishizaki ..... B27B 17/02 30/123.4
4,981,129 A * 1/1991 Osterman ..... B27B 17/02 125/21
5,669,140 A * 9/1997 Tsumura ..... B27B 17/025 30/123.4

FOREIGN PATENT DOCUMENTS

SE 446250 B 8/1986

* cited by examiner

*Primary Examiner* — Evan MacFarlane
*Assistant Examiner* — Liang Dong
(74) *Attorney, Agent, or Firm* — Novick, Kim & Lee, PLLC; Sang Ho Lee

(57) ABSTRACT

This invention relates to a nose assembly for a chainsaw guide bar for wood harvesting and a chainsaw guide bar having the same. The nose assembly (400) comprising: a pair of nose side plates (410, 420; 470); and a sprocket and bearing assembly adapted to be clamped between the pair of nose side plates (410, 420; 470) and comprising an idler sprocket (450); wherein at least one of the pair of the nose side plates (410, 420; 470) is provided at an inside surface thereof facing to the sprocket and bearing assembly with one or more lubricant conveying channels for lubricating the sprocket and bearing assembly. The chainsaw guide bars according to the present invention enable flow of lubricant to moving parts in order to reduce friction of these moving parts as a saw chain rotates though the guide bar.

12 Claims, 6 Drawing Sheets

A-A

A-A

CHAINSAW GUIDE BAR NOSE ASSEMBLY

BACKGROUND OF THE INVENTION

Technical Field

This invention relates in general to chainsaw guide bars for wood harvesting and relates in particular to a detachable and replaceable chainsaw guide bar nose assembly or attachment for fitment to a chainsaw guide bar body and which, when in operation, receives a supply of lubricating fluid from the guide bar body and/or chain and directs it into the chainsaw guide bar nose assembly and hence to moving parts subject to frictional wear via lubricant (or lubricating) conveying (or flow/delivering/supply) channels (e.g., grooves) of special configuration formed within the nose side plate of the nose assembly.

Description of the Prior Art

Chainsaw guide bars are commonly fitted with a detachable nose assembly which incorporates a toothed idler sprocket rotatably mounted about a fixedly disposed central bearing member by means of a bearing race interposed between the sprocket and the fixed bearing which is secured between a pair of nose side plates.

Chainsaw guide bars are provided with a peripheral groove. This groove constrains the movement of the saw chain and also provides a means to convey lubricant from lubrication holes at the end of the bar mounted on the chainsaw or harvester machine to all other areas on the periphery of the guide bar. This groove also allows lubricant to be conveyed to the saw chain, providing lubrication to the moving parts on the saw chain. The lubrication can travel towards the nose of the guide bar, either by travelling along the bottom of the bar groove or by becoming attached to the saw chain itself. The lubricant, after travelling to the nose of the bar has no positive means to lubricate the bearing in the nose assembly itself. The lubricant that makes it to the sprocket is thrown off by the centrifugal forces as the sprocket is rotated by the chain.

SUMMARY OF THE INVENTION

An object of this invention to prevent or at least alleviate premature wear of moving parts of a chainsaw guide bar in the vicinity of the rotatable idler sprocket and central bearing member thereof, by providing lubricant-conveying channels which will allow oil to pass by the rotating sprocket and enter into the bearing area without being thrown off by centrifugal forces.

According to one aspect of the invention there is provided a chainsaw guide bar with a lubricant conveying channel (e.g., groove) connectable to a nose plate attachment (i.e., a nose assembly), the attachment comprising an idler sprocket rotatable by a saw chain moving around the guide bar and which is mounted for rotation about a fixed central bearing member via a roller bearing race of the bearing and with it the idler sprocket and roller bearing race forming a sprocket and bearing assembly which is adapted to be clamped between a pair of nose side plates, at least one nose side plate being provided with one or more lubricant conveying grooves for supplying lubricant to moving parts subject wear, the nose assembly being adapted to be removably fixed to the guide bar body by corresponding attachment means on the nose end of the guide bar for replacement as required.

In a particular aspect of the nose side plate attachment of the invention, the roller bearing race of the sprocket and bearing assembly includes a plurality of roller bearings disposed within an annular gap or channel formed between an inner circumferential edge of the rotatable idler sprocket and an outer circumferential edge of the centrally disposed bearing member of the sprocket and bearing assembly.

According to another aspect of the invention there is provided a nose assembly for a chainsaw guide bar, comprising a pair of nose side plates; and a sprocket and bearing assembly adapted to be clamped between the pair of nose side plates and comprising a saw chain-rotatable idler sprocket; wherein at least one of the pair of the nose side plates is provided at an inside surface thereof facing to the sprocket and bearing assembly with one or more lubricant conveying channels for lubricating the sprocket and bearing assembly.

More particularly, the chainsaw guide bar nose plate attachment of the invention comprises a (saw chain-rotatable idler) sprocket and bearing assembly adapted to be clamped between a pair of chainsaw guide bar nose side plates, the assembly comprises a saw chain-rotatable idler sprocket mounted for rotation about a central bearing member which is provided with an annular arrangement of a plurality of rivet holes which enable the central sprocket-bearing member to be riveted to and between the pair of nose side plates, the sprocket and bearing assembly also includes a roller bearing race carrying a plurality of roller bearings disposed within an annular gap or channel formed between an inner circumferential edge of the rotatable idler sprocket and an outer circumferential edge of the centrally disposed bearing of the sprocket and bearing assembly.

The invention according to a broad aspect comprises a chainsaw guide bar nose side plate which incorporates one or more lubricant conveying channels (e.g., groove or grooves) on at least one side surface thereof.

According to a particular aspect of the invention the nose assembly side plates of the chainsaw guide bar nose assembly are each provided on the side (inwardly-facing) surface thereof—when installed—one or more specially-configured, flow directing, lubricant conveying channels (grooves) preferably comprise divergent pairs of lubricant conveying grooves consisting firstly of a pair of elongate, curved outer grooves and secondly, a pair of shorter, straight inner grooves wherein each shorter inner channel diverges from and is fluidly joined to the respective elongate, fluid-conducting and directing outer groove.

In one form of the invention which may be a preferred construction, when assembled and installed, the inwardly-facing surface of at least one nose side plate is provided with a plurality of lubricant conveying channels (e.g., grooves).

Specifically, the invention according to a related aspect provides a method of manufacturing a chainsaw guide bar nose assembly with built in lubricant conveying channels or grooves connectable to corresponding lubricant conveying channel or groove formed in a guide bar body, the method comprises clamping a saw chain-rotatable idler sprocket and bearing assembly between a pair of chainsaw guide bar nose side plates to form a chainsaw nose assembly, the sprocket and bearing assembly also including means for fixing it to the guide bar then fixing the assembly so-formed to the end of a guide bar via attachment fixing apertures.

The oil will travel down the bar body groove until it comes to the end of the bar body groove. It then will drip down to the bottom side of the bar body. The grooves in the nose side plate are there to catch some of this oil and give it a passage around the sprocket so it can get to the bearing rollers. Therefore the connection of the grooves on the nose side plates with the groove in the bar body means to build a communication passage there between.

According to another embodiment of the present disclosure, a method of manufacturing a chainsaw guide bar is provided. The method includes providing a chainsaw guide bar body and a chainsaw guide bar nose assembly, the nose assembly including a pair of nose side plates, and a sprocket and bearing assembly adapted to be clamped between the pair of nose side plates and including a saw chain-rotatable idler sprocket, at least one of the pair of the nose side plate being provided at an inside surface thereof facing to the sprocket and bearing assembly with one or more lubricant conveying channels for lubricating the sprocket and bearing assembly, and fixedly connecting the chainsaw guide bar nose assembly to the chainsaw guide bar body, such that the one or more lubricant conveying channels provided at an inside surface of a nose side plate of the chainsaw guide bar nose assembly is connected with a corresponding lubricant conveying channel formed in the guide bar body.

DETAILED DESCRIPTION OF THE INVENTION

Figure 1:
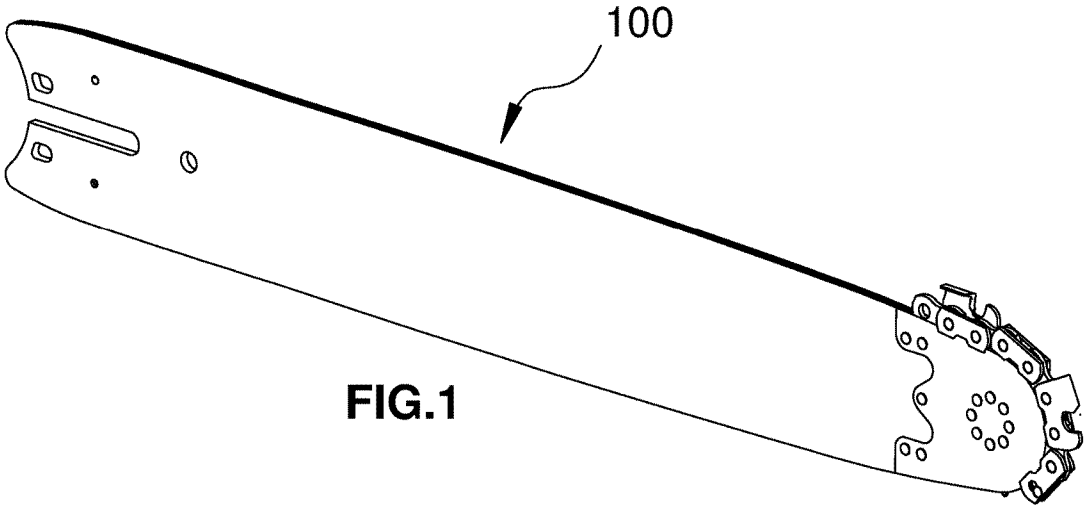
FIG. 1 is a perspective view of a chainsaw guide bar with replaceable nose assembly according to one embodiment of the invention.
Figure 2:
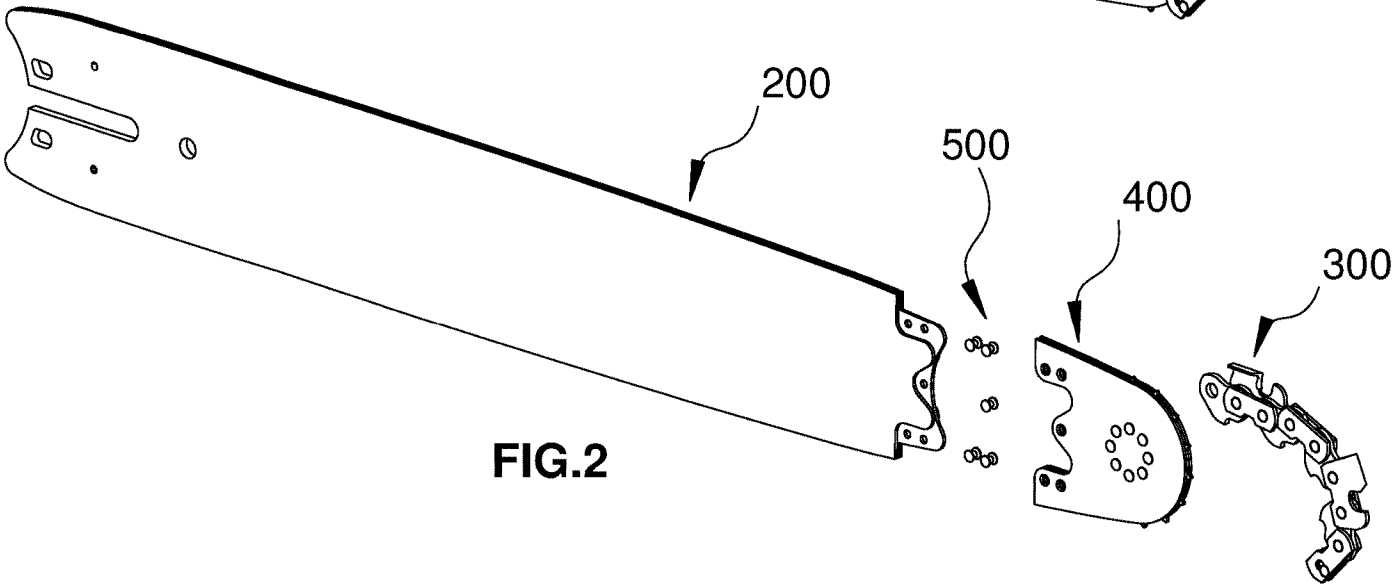
FIG. 2 is an exploded view in perspective of separated components of the chainsaw guide bar of FIG. 1.

Referring to the accompanying drawings and firstly to the embodiment shown in FIG. 1, there is shown a chainsaw guide bar 100 with a replaceable nose assembly 400 attached thereto and which as shown in the exploded partial view of FIG. 2 comprises a guide bar body 200, a segment of chainsaw chain 300 and a nose assembly 400 with rivets 500 used to assemble the nose assembly 400 to the guide bar body 200.

Figure 3A:
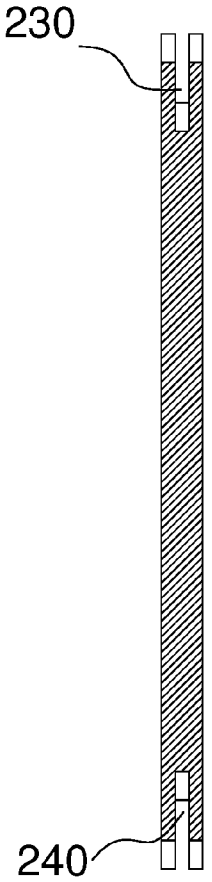
FIG. 3A is a section view along the line A-A of FIG. 3 of chainsaw guide bar body.
Figure 3:
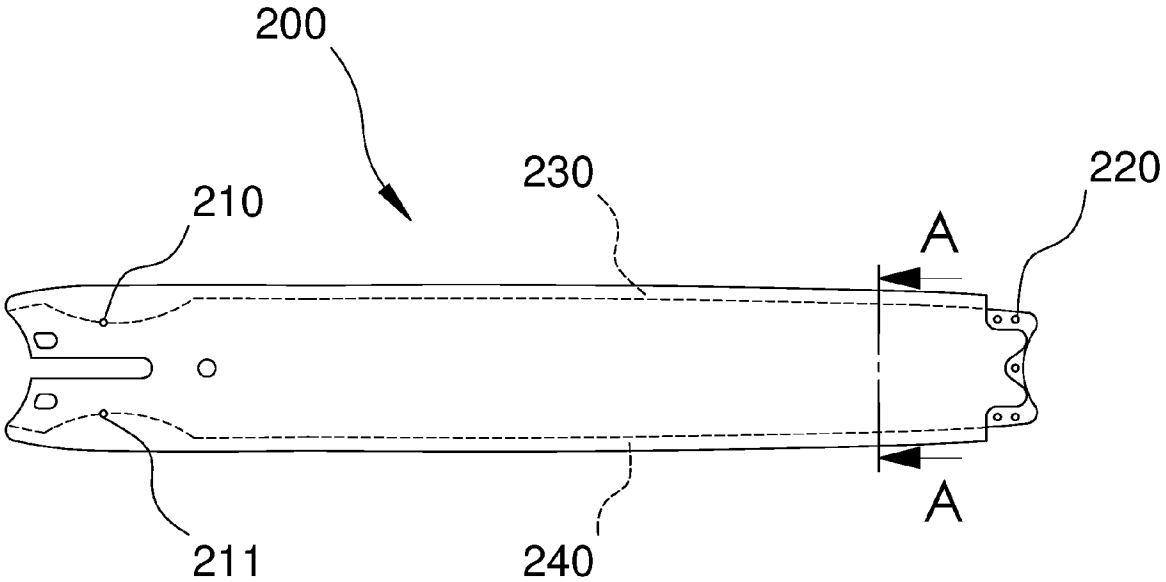
FIG. 3 is an elevation view of a chainsaw guide bar body prior to attachment thereto of the nose assembly of the invention.

As shown in FIG. 3 the guide bar body 200 is provided at one (or right-hand shown) end with rivet holes 220 and at the other end with lubrication holes 210 and 211. FIG. 3A shows guide bar lubricant conveying grooves 230 and 240.

Figure 5:
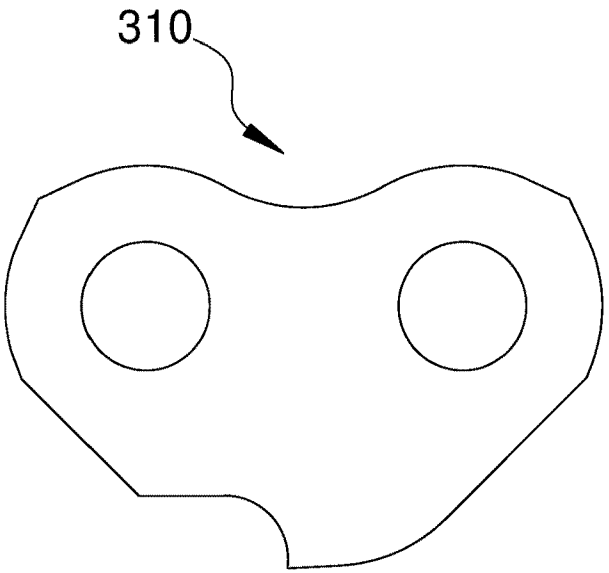
FIG. 5 is a view on an enlarged scale of a drive link of the chainsaw chain of FIG. 4.
Figure 4:
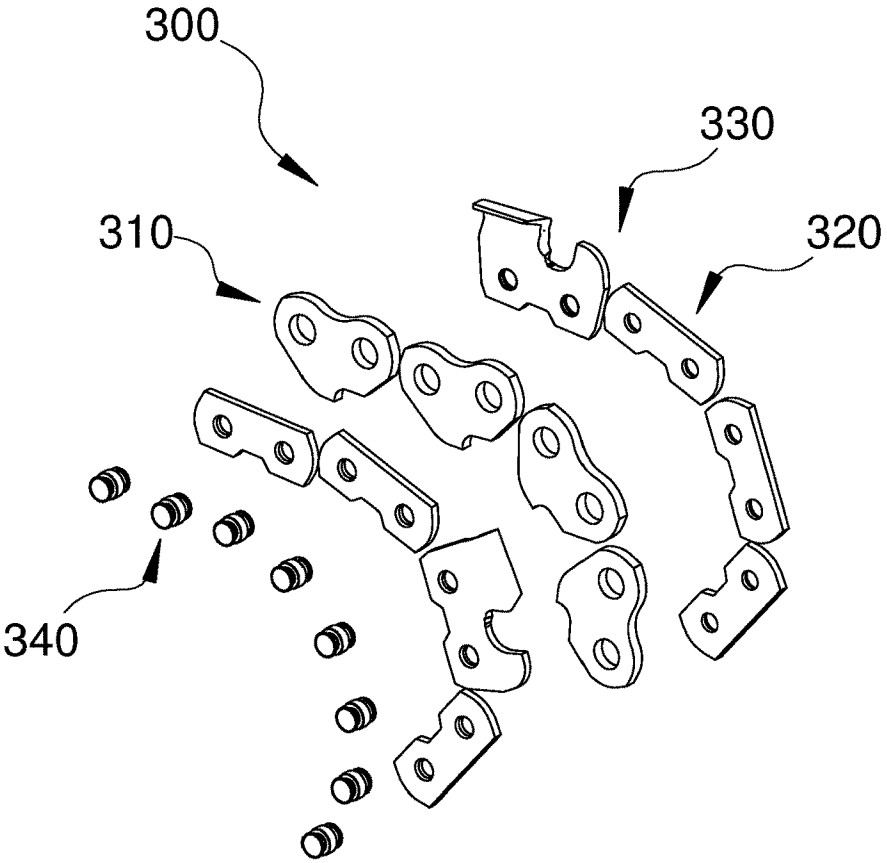
FIG. 4 is an exploded view of components of a typical chainsaw chain.

FIGS. 4 and 5 show components of a chainsaw chain 300 suitable for use with the present invention and which comprise drive links 310, side plates (or joining links) 320, cutting links 330 and rivets 340 for assembling the chain.

Figure 6:
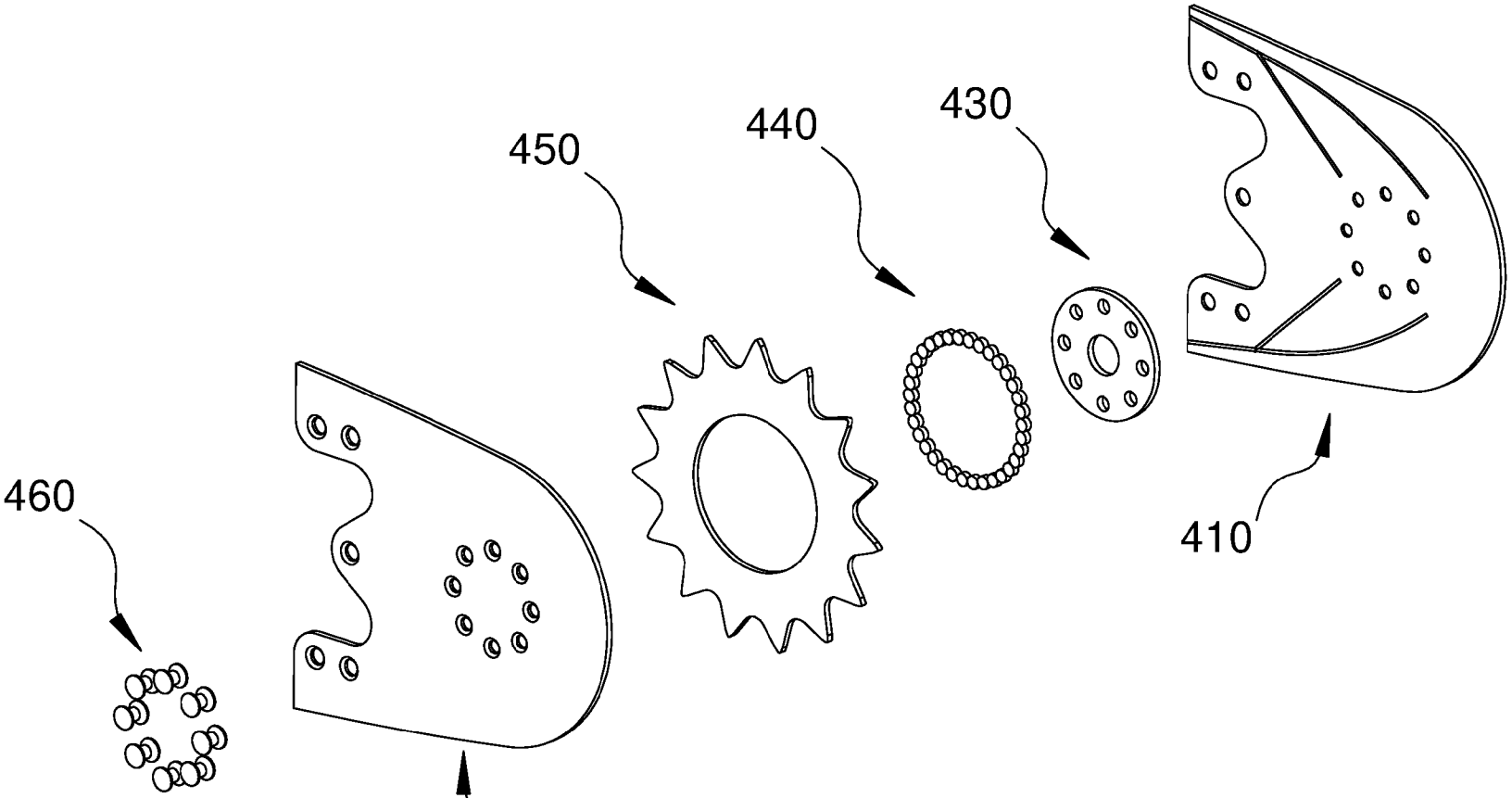
FIG. 6 is an exploded view of the components of the chainsaw guide bar nose assembly.

The exploded view of FIG. 6 shows components of the nose assembly which comprise a pair of side plates 410 and 420, a central bearing member (or bearing inner race) 430, a plurality of bearing rollers 440 and an idler (chain-driven) sprocket (or outer bearing race) 450. The components of the nose assembly are fastened together by rivets-eight of these being shown in FIG. 6 one such rivet being labeled 460 and for use with respect to the eight rivet holes shown in FIG. 7 and one such rivet hole being labeled 416.

Figure 9:
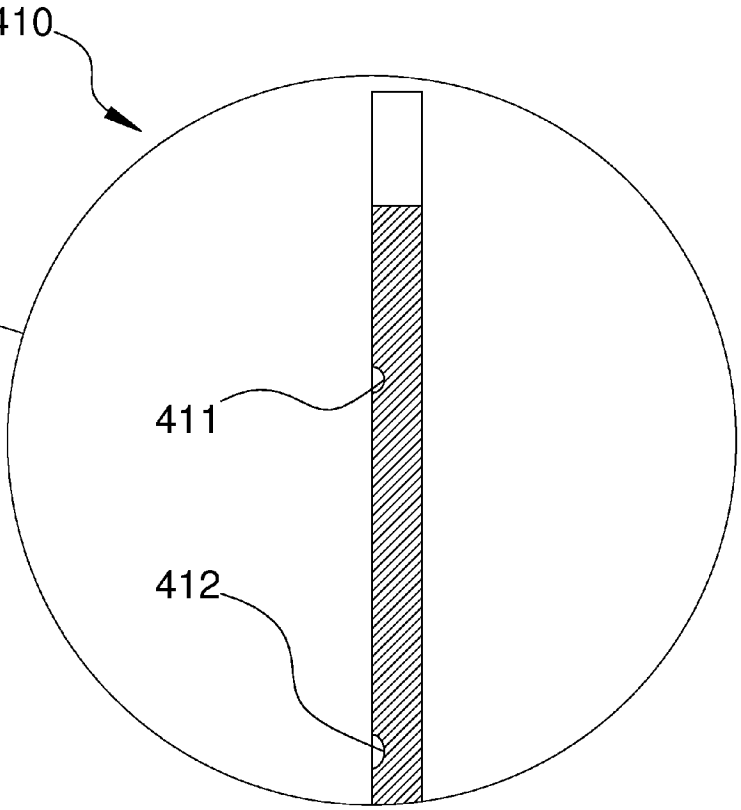
FIG. 9 is that part on an enlarged scale of that part of the Section A-A of FIG. 8.
Figure 8:
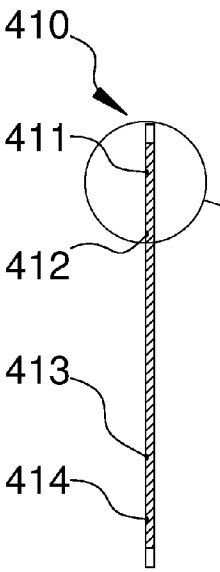
FIG. 8 is vertical section view along the line A-A of FIG. 7.
Figure 7:
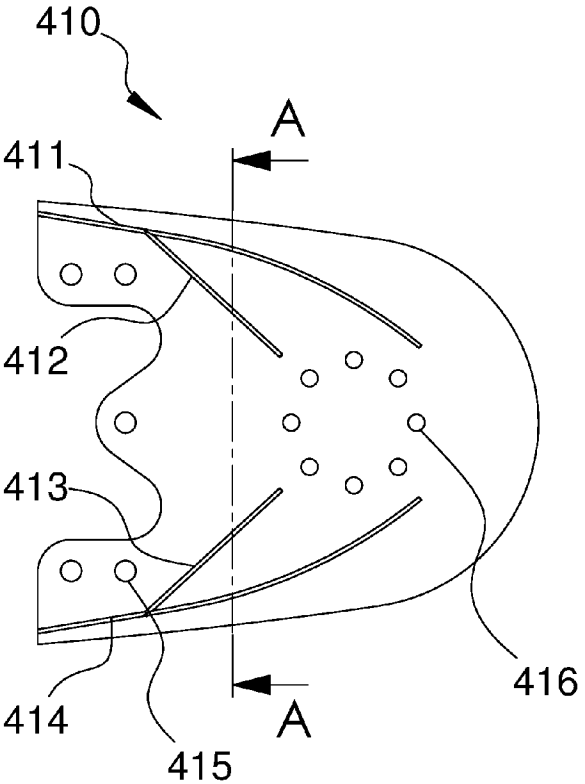
FIG. 7 is an inside plan view of one of a pair of nose side plates.

Referring again to FIG. 7 and to FIGS. 8 and 9, each of the nose side plates 410, 420 is provided at the inside surface thereof with two groups of the lubricant conveying channels positioned symmetrically about a longitudinal axis of the nose side plates 410, 420, and preferably, each of the pair of the lubricant-conveying channels comprises a plurality of lubricant conveying grooves 411, 412 extended divergently towards the sprocket and bearing assembly. FIG. 9 shows in greater detail the left side plate 410 shown in FIGS. 6 and 7, the left hand side plate is provided with a plurality of lubricant conveying grooves 411 to 414 which generally comprise a pair of elongate, curved, outer lubricant conveying grooves and a pair of short, linear inner lubricant conveying grooves. Each respective longer outer lubricant conveying groove is joined to a respective shorter inner lubricant conveying groove and both long and short-type lubricant conveying grooves may be considered as being mutually-divergent so as to create divergent streams of lubricant. One longer and outer lubricant conveying groove is adjacent one edge of the side plate and is labeled 411 and is joined by a shorter inner lubricant conveying groove labeled 412. The other longer and outer channel is adjacent one edge of the side plate and is labeled 413 and is joined by a shorter inner lubricant-delivering channel 414. FIG. 7 also shows a plurality of rivet holes used for assembling components of the invention; five rivet holes are used to assemble the guide bar body and nose assembly and these holes are typified by the one labeled 415. Eight rivet holes are used to assemble the components of the nose assembly, one of these being labeled 416.

Figure 10:
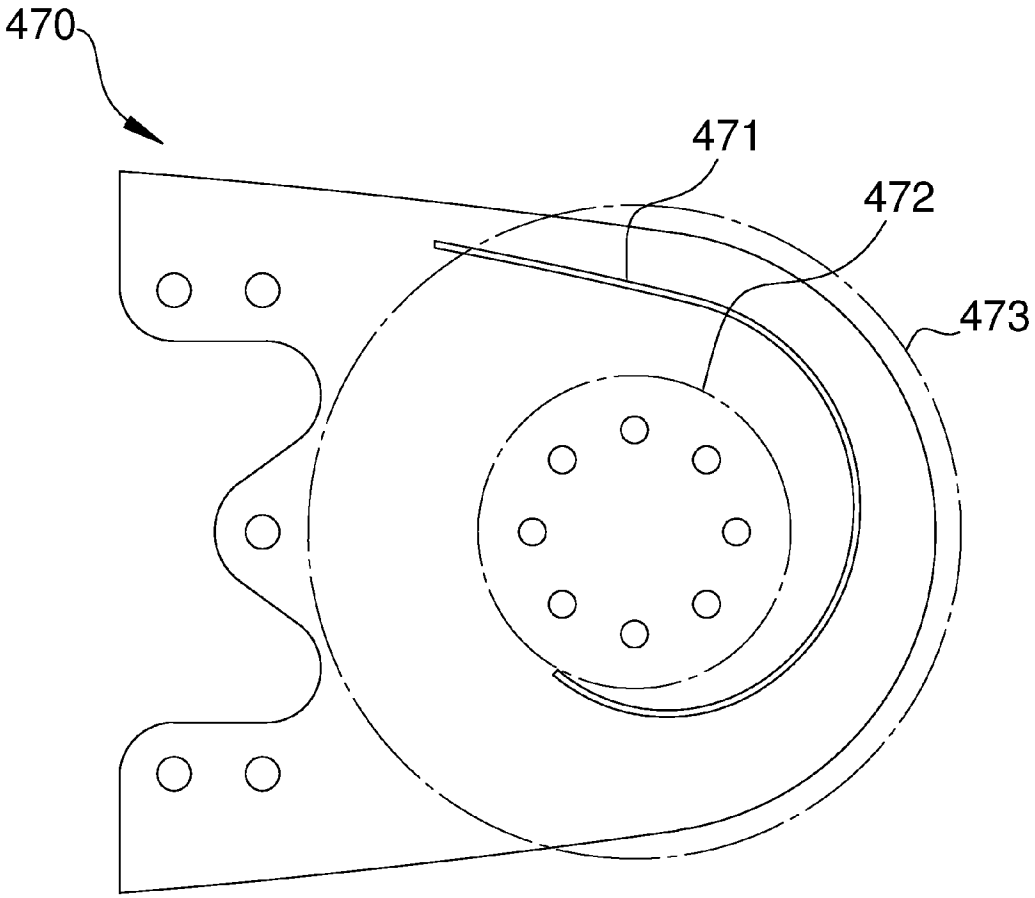
FIG. 10 is an inside elevation of another embodiment of the invention and shows a nose side plate for the chainsaw guide bar nose assembly.

Referring to FIG. 10 there is shown an inside view of a different embodiment of the invention and which comprises a nose side plate 470 which has an inside surface of alternative configuration to that of the earlier embodiments and wherein each nose side plate may be of the same or different geometry. The inside surface of the nose side plate shown FIG. 10 has a single lubricant conveying groove 471 of curved configuration formed in the inside surface but, if desired, the lubricant conveying groove may follow a spiral path. FIG. 10 further shows in broken outline the inside diameter (inner circumferential edge) 472 and the outside diameter (outer circumferential edge) 473 respectively of the idler sprocket 450 shown in FIG. 9. Preferably, the lubricant conveying groove 471 with one end thereof extends to a position corresponding to an inner circumferential edge of the idler sprocket 450.

The lubricant conveying groove of each nose side plate of the invention can be of any suitable geometry, path and depth.

Whilst I have described in the foregoing embodiment a specific concept, forms and application of my invention, it will be understood by some persons skilled in this particular art that variations, modifications, substitutions and additions may be made without departing from the spirit and scope of this invention and I therefore do not wish to be understood as limiting ourselves to the precise terms used.

The invention claimed is:

1. A chainsaw guide bar comprising a guide bar body and a nose assembly, wherein the nose assembly comprising a pair of nose side plates used in a chainsaw guide bar, wherein at least one inside surface of each of the pair of nose side plates has one or more lubricant conveying channels; and a sprocket and bearing assembly adapted to be clamped between the pair of nose side plates and comprising a saw chain-rotatable idler sprocket;

wherein the at least one inside surface of the pair of the nose side plates is disposed to face the sprocket and bearing assembly and is configured to provide lubricant via the one or more lubricant conveying channels to the sprocket and bearing assembly, and the nose assembly is detachably attached to the guide bar body, the one or more lubricant conveying channels defined on at least one inside surface of the pair of nose side plates are connected with a corresponding lubricant conveying channel defined in a periphery of the guide bar body.

2. The chainsaw guide bar according to claim 1, wherein each of the one or more lubricant conveying channels comprises a plurality of lubricant conveying grooves extended divergently towards the sprocket and bearing assembly.

3. The chainsaw guide bar according to claim 1, wherein one of the one or more lubricant conveying channels is a single curved lubricant conveying groove following having a spiral path.

4. The chainsaw guide bar according to claim 3, wherein the single curved lubricant conveying groove has one end thereof extending to a position corresponding to an inner circumferential edge of the idler sprocket.

5. The chainsaw guide bar according to claim 1, wherein the sprocket and bearing assembly further comprising:

a central bearing member around which the idle sprocket mounted rotatably and is fixedly connected to and clamped between the pair of nose side plates; and a plurality of rollers disposed within an annular gap formed between the idler sprocket and the central bearing member.

6. The chainsaw guide bar according to claim 5, wherein the central bearing member is fixedly connected to and clamped between the pair of nose side plates.

7. A chainsaw guide bar comprising a guide bar body and a nose assembly, wherein the nose assembly is detachably attached to the guide bar body and comprises:

a pair of nose side plates; and a sprocket and bearing assembly adapted to be clamped between the pair of nose side plates and comprising a saw chain-rotatable idler sprocket;

wherein at least one inside surface of the pair of the nose side plates has one or more lubricant conveying channels and is disposed to face the sprocket and bearing assembly and is configured to provide lubricant via the one or more lubricant conveying channels to the sprocket and bearing assembly, and wherein the one or more lubricant conveying channels defined on the at least one inside surface of the pair of nose side plates of the nose assembly are connected with a corresponding lubricant conveying channel defined in a periphery of the guide bar body.

8. The chainsaw guide bar according to claim 7, wherein the at least one inside surface of the pair of the nose side plates has two groups of the lubricant conveying channels positioned symmetrically about a longitudinal axis of each of the pair of nose side plates.

9. The chainsaw guide bar according to claim 8, wherein each of the two groups of the lubricant conveying channels comprises a plurality of lubricant conveying grooves extended divergently towards the sprocket and bearing assembly.

10. The chainsaw guide bar according to claim 7, wherein one of the one or more lubricant conveying channels is a single curved lubricant conveying groove having a spiral path.

11. The chainsaw guide bar according to claim 10, wherein the single curved lubricant conveying groove has one end thereof extending to a position corresponding to an inner circumferential edge of the idler sprocket.

12. The chainsaw guide bar according to claim 7, wherein the sprocket and bearing assembly further comprising:

a central bearing member around which the idle sprocket mounted rotatably; and a plurality of rollers disposed within an annular gap formed between the idler sprocket and the central bearing member.

* * * * *